United States Patent [19]

Sung et al.

[11] Patent Number: 4,676,917

[45] Date of Patent: Jun. 30, 1987

[54] RAILWAY DIESEL CRANKCASE LUBRICANT

[75] Inventors: Rodney L. Sung, Fishkill; Benjamin H. Zoleski, Beacon; Ronald L. O'Rourke, Hyde Park, all of N.Y.

[73] Assignee: Texaco Inc., White Plains, N.Y.

[21] Appl. No.: 833,696

[22] Filed: Feb. 27, 1986

[51] Int. Cl.[4] ..... C10M 129/00; C10M 133/00

[52] U.S. Cl. ..... 252/51.5 A; 252/51.5 R

[58] Field of Search ..... 252/51.5 A, 51.5 R

[56] References Cited

U.S. PATENT DOCUMENTS

| | | | |
|---|---|---|---|
| 3,936,480 | 2/1976 | Demoures et al. | 252/51.5 A |
| 3,948,909 | 4/1976 | Okamoto | 252/51.5 A |
| 4,048,080 | 9/1977 | Lee et al. | 252/51.5 A |
| 4,374,741 | 2/1983 | Rieder | 252/51.5 A |
| 4,427,562 | 1/1984 | Horodysky et al. | 252/51.5 A |
| 4,464,276 | 8/1984 | Sung et al. | 252/51.5 A |
| 4,505,835 | 3/1985 | Sung et al. | 252/51.5 A |
| 4,512,903 | 4/1985 | Schlicht | 252/51.5 A |

*Primary Examiner*—William R. Dixon, Jr.
*Assistant Examiner*—Cynthia A. Prezlock
*Attorney, Agent, or Firm*—Robert A. Kulason; James J. O'Loughlin; Vincent A. Mallare

[57] ABSTRACT

A crankcase lubricating oil composition for railway diesel engines, containing a mineral lubricating oil, an overbased calcium alkylphenolate and an alkyaryl sulfonate oxidation and corrosion inhibiting amount of a reaction product of polyoxyisopropylene diamine, dibasic acid anhydride and polyalkylene polyamine.

9 Claims, No Drawings

RAILWAY DIESEL CRANKCASE LUBRICANT

BACKGROUND OF THE INVENTION

1. Field of the Invention

This invention is related to a railway diesel engine lubricant having improved properties of inhibition of oxidative and corrosive effect. More particularly, this invention relates to anti-oxidation and anti-corrosion additives for railway diesel lubricants used in railway diesel engines.

Over the past ten years the price of diesel fuel has increased dramatically. As an example, the price of marine diesel fuel has increased from $11 a metric ton to currently about $200 a metric ton. Additionally, a similar increase in fuel cost has been experienced by the railroad industry. These increases have resulted in the cost of fuel being the largest expense for the owners of any diesel fleet of vehicles. To try to obtain some relief from this large expense the railroads have embarked on a program of mixing poorer grade fuels (such as marine residual) with the regular D-2 diesel fuel. While they do realize a savings from this mixed fuel operation, other engine performance problems arise, such as increased corrosion and poorer oxidative stability. The proportions of the problems can be observed when one sees General Electric spending $20 million dollars to build new test facilities to evaluate the parameters involved and General Motors (EMD) exerting a similar type of effort to also study the problem.

The present invention deals with the scenario where diesel fuel (D-2) is extended with diesel residual fuel, as proposed by the railway industry. As a result, railway diesel oil (RDO) will be subjected to more severe conditions during operation. We have simulated the scenario wherein RDO is contaminated with a given amount of marine diesel residual fuel. We believe this to be a realistic test since during normal engine operation D-2 gets into the diesel crankcase. We used the Union Pacific Oxidation Test (UPOT) to evaluate the effectiveness of the experimental additives in reducing corrosion and oxidative thickening of the RDO.

2. Disclosure Statement

U.S. Pat. No. 4,419,105 discloses the use of the reaction product of maleic anhydride and certain amines or diamines as corrosion inhibitors in alcohols.

U.S. Pat. No. 4,321,062 discloses the use of the reaction product of maleic anhydride, certain phenols, and certain alkyl-alkylene diamines as a corrosion inhibitor and carburetor detergent additive in motor fuels.

U.S. Pat. No. 4,290,778 discloses the use of the reaction product of a hydrocarbyl alkoxyalkylene diamine and maleic anhydride as a corrosion inhibitor and carburetor detergent additive in motor fuels.

U.S. Pat. No. 4,207,079 discloses the use of the reaction product of maleic anhydride and certain alkyl-alkylene diamines as a corrosion inhibitor and a carburetor detergent additive in motor fuels.

U.S. Pat. No. 4,144,034 discloses the use of the reaction product of a polyether amine and maleic anhydride as a carburetor detergent and corrosion inhibitor in motor fuels.

U.S. Pat. No. 3,773,479 discloses the use of the reaction product of maleic anhydride and alkyl or alkylene amines as a carburetor detergent, corrosion inhibitor, and anti-icing additive in motor fuels.

SUMMARY OF THE INVENTION

We have discovered the reaction product of polyoxyisopropylene diamine, diabasic acid anhydride and polyalkylene polyamine which is substantially less susceptible to undesired oxidation during engine operating and substantially less corrosive to the metal engine parts such as copper, iron, steel, iron and lead metal surfaces improved resistance to oxidative deterioration is measured by the change in the lubricating oil viscosity and engine corrosion.

The novel reaction product of the instant invention is obtained by reacting dibasic acid anhydride with a polyoxyisopropylene diamine represented by the formula:

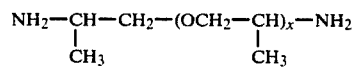

where x has a value from about 2 to about 50, preferably from about 4 to about 10 thereby forming a maleamic acid which then reacts with a polyalkylene polyamine. It is represented as follows:

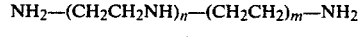

where n is a numeral of about 0 to about 4, preferably about 1 to about 3 and m is a numeral of about 0 to about 2, about 1.

The dibasic acid anhydrides of the present invention, may be represented by the formula

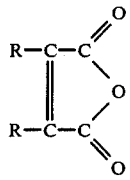

where R is H, $CH_3$— or $C_2H_5$—.

Accordingly, the dibasic acid anhydrides may include the following:

maleic anhydride
alpha-methyl maleic anhydride
alpha-ethyl maleic anhydride
alpha, beta-dimethyl maleic anhydride The preferred dibasic acid anhydride is maleic anhydride.

The novel method of the invention involves operating a railway diesel engine by supplying the above-described lubricating oil composition to the crankcase lubrication system of the engine.

SPECIFIC EMBODIMENTS OF THE INVENTION

In a more specific embodiment of the invention, the crankcase lubricating composition of the invention will comprise at least 80 weight percent of a mineral lubricating oil, a minor amount of oxidation-corrosion inhibiting additive which is (i) reacting a dibasic acid anhydride with a polyoxyisopropylenediamine $$NH_2-\underset{\underset{CH_3}{|}}{CH_2}-CH_2-[O-CH_2\underset{\underset{CH_3}{|}}{CH}]_x-NH_2$$

where x has a value from about 2 to 50, thereby forming a maleamic acid;

(ii) reacting said maleamic acid with a polyalkylene polyamine $$NH_2-(CH_2CH_2NH)_n-(CH_2CH)_m-NH_2$$

where n has a value of from about 0 to about 4, and m has a value of from about 0 to about 2, thereby forming a condensate product; and (iii) recovering said condensate product.

The composition can also contain minor amount of an antifoam agent such as a dialkyl silicone.

DETAILED DESCRIPTION OF THE INVENTION

The novel reaction product of this invention is prepared by reacting a dibasic acid anhydride, e.g., maleic anhydride, a polyoxyisopropylenediamine, and a polyalkylene polyamine.

The polyoxyisopropylenediamine reactant is represented by the formula $$NH_2-\underset{\underset{CH_3}{|}}{CH}-CH_2-[O-CH_2-\underset{\underset{CH_3}{|}}{CH}]_x-NH_2$$

where x has a value of from about 2 to about 50, preferably from about 4 to about 10.

The molecular weight $\overline{M}_n$ of the polyoxyisopropylenediamines may range from about 230 to about 2000. Examples of the polyoxyisopropylenediamine which may be employed herein include those listed below in Table I. These polyoxyisopropylene-diamines are commercially available under the tradename of JEFFAMINE-D which are manufactured by Texaco Chemical Company of Houston, Tex.

TABLE I

| | |
|---|---|
| A. JEFFAMINE D-230 | $NH_2-\underset{\underset{CH_3}{\vert}}{CH}-CH_2-(OCH_2-\underset{\underset{CH_3}{\vert}}{CH})_x-NH_2$ (where x is 2 or 3) |
| B. JEFFAMINE D-400 | $NH_2-\underset{\underset{CH_3}{\vert}}{CH}-CH_2-(OCH_2-\underset{\underset{CH_3}{\vert}}{CH})_x-NH_2$ (where x is 5 or 6) |
| C. JEFFAMINE D-2000 | $NH_2-\underset{\underset{CH_3}{\vert}}{CH}-CH_2-(OCH_2-\underset{\underset{CH_3}{\vert}}{CH})_x-NH_2$ (where x is 33) |

The polyalkylene polyamine reactant is represented by the formula:

$$NH_2-(CH_2CH_2NH)_n-(CH_2CH_2)_m-NH_2$$

where n is about 0 to about 4, preferably about 1 to about 3, and m is about 0 to about 2, preferably about 1.

Examples of polyalkylene polyamines in include:

$$NH_2-CH_2-CH_2-NH-CH_2-CH_2-NH_2$$

$$NH_2-CH_2-CH_2-NH-CH_2-CH_2-N-H-CH_2CH_2-NH_2$$

$$NH_2-CH_2-CH_2-NH-CH_2-CH_2-NH-CH_2-CH_2-NH-CH_2-CH_2-NH_2$$

$$NH_2-CH_2-CH_2-NH-CH_2-CH_2-NH-CH_2-CH_2-NH-CH_2-CH_2-NH-CH_2CH_2-NH_2$$

The dibasic acid anhydrides of the present invention, may be represented by the formula

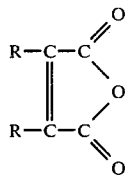

where R is H, $CH_2$— or $C_2H_5$—.

Accordingly, the dibasic acid anhydrides may include the following:

maleic anhydride;

alpha-methyl maleic anhydride;

alpha-ethyl maleic anhydride;

alpha, beta-dimethyl maleic anhydride.

The preferred dibasic acid anhydride is maleic anhydride.

The reaction product is prepared by first reacting maleic anhydride with the prescribed polyoxyisopropylenediamine. The reaction of 1-2 mole, say 1 mole of maleic anhydride with 1-2 moles, say 1.0 mole of the polyoxyisopropylenediamine is preferably carried out in the presence of a solvent. A preferred solvent is one which will distill with water azeotropically. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include hexane, cyclohexane, benzene, toluene, and mixtures thereof. Xylene is the preferred solvent. The solvent can be present in an amount of up to about 90% by weight of the total reaction mixture. Then, the mixture is cooled to about 60° C. where 1 to 2 moles of a polyalkylene polyamine is added. The mixture with the polyamine is continued to be heated for 2 hours at 100° C. After vacuum stripping the solvent from the mixture, the resulting product is the instant condensate product.

In a preferred method for preparing the reaction product, the 1 mole maleic anhydride and 1 mole polyoxyisopropylenediamine are combined with the solvent xylene and reacted at a temperature of about 100° C. The reaction mixture is maintained at this temperature for approximately 2 hours. The mixture is then cooled to about 60° C., whereupon 1-2 mole, say 1 mole of polyalkylene polyamine is added. The new mixture is then reacted at about 100° C. for approximately 2 hours. The reaction product can then be separated from the solvent using conventional means, or left in a mixture with some or all of the solvent to facilitate addition of the reaction product to gasoline or another motor fuel composition. The final reaction product structure (as evidenced by elemental analysis, IR analysis, and NMR analysis) may be represented by the following flow process diagram.

In the process illustrated below, initially, maleic anhydride (A) is reacted with polyoxyisopropylenediamine (B) to form maleamic acid (C). Then, the maleamic acid (C) is reacted with a polyalkylene polyamine (D) to form the condensate product (E) of polyoxyisopropylenediamine, maleic anhydride, and polyalkylene polyamine. Accordingly, the condensate product (E) is recovered.

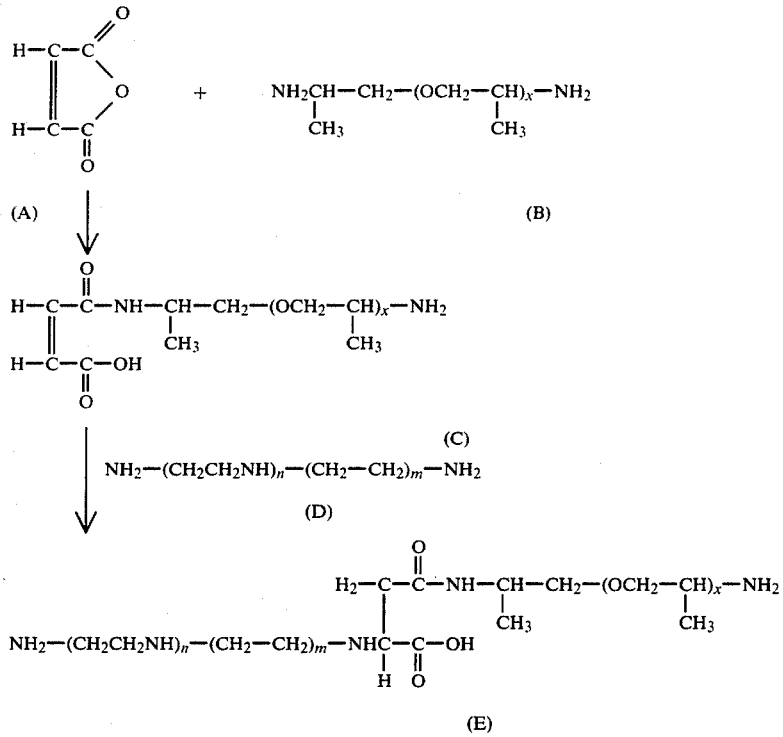

wherein x is a numeral of about 5.0, n is about 0 to about 4, and m is about 0 to about 2.

The prepared reaction product, i.e., condensate product may be added to a fuel in a minor deposit-inhibiting amount of about 0.001 to about 0.1 weight percent, and preferably from about 0.01 to about 0.1 weight percent of the reaction product.

The advantages and features of the present invention will be more apparent from the Examples below. The following examples illustrate the preferred method of preparing the reaction product of the instant invention. It will be understood that the following examples are merely illustrative and are not meant to limit the invention in any way. In the example, all parts are parts by weight unless otherwise specified.

The Jeffamine D series are manufactured and marketed by Texaco Chemical Company of Houston, Tex.

EXAMPLE I

A reaction product was formed by racting 245 parts of maleic anhydride. 260 parts of xylene, and 102.7 parts of the polyoxyisopropylenediamine JEFFAMINE D-400 at 100° C. for 2 hours. JEFFAMINE D-400 is a polyoxyisopropylenediamine of approximate molecular weight 5.9 having the general formula:

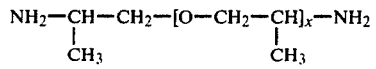

where x has an approximate value of 2 to 50. The mixture was thereafter cooled to about 60° C., and 25.8 parts of diethylene triamine were added. The new mixture was then reacted at about 100° C. for 2 hours to produce the final reaction product. The reaction product was filtered and stripped of the remaining solvent under a vacuum. The final reaction product structure (as evidenced by elemental analysis, IR analysis, and NMR analysis) was as previously described.

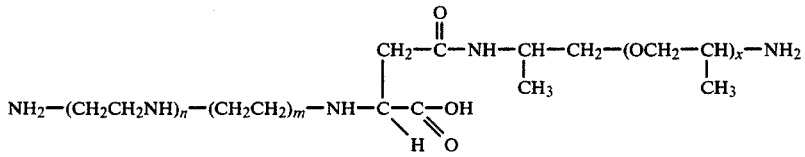

ps where x has a value from about 20 to 50 depending upon the particular JEFFAMINE D reactant employed, and n has a value from about 0 to 4 and m has a value from about 0 to 2, depending upon the particular polyalkylene polyamine reactant employed.

The anti-oxidation and anti-corrosion agents are provided in the examples below.

IN examples II through VII, the same procedure is used as that in Example I except for the amount of polyoxyisopropylenediamine and polyalkylene polyamine. Thus, for each example, the amount of polyether amine and polyalkylene polyamine are provided below with the structure of the condensate product.

EXAMPLE II

Amount of Jeffamine D-400: 410.7 parts.
Amount of Diethylene Triamine: 103 parts.

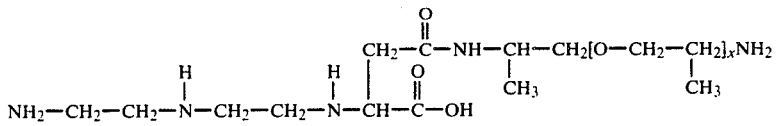

(where x is 5.58).

EXAMPLE III

Amount of Jeffamine D-400: 410.7 parts.
Amount of triethylene Tetramine: 145 parts.

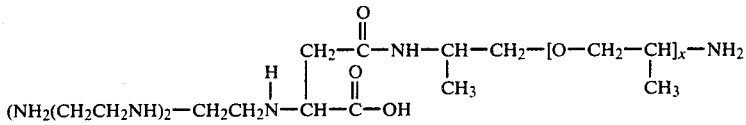

(where x is 5.58).

EXAMPLE IV

Amount of Jeffamine D-230: 114.8 parts.
Amount of Diethylene Triamine: 103 parts.

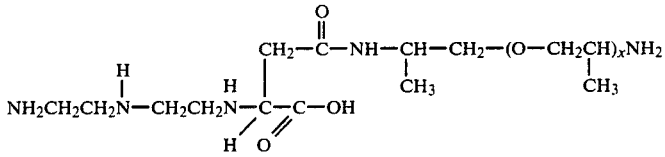

(where x is 2–3).

EXAMPLE V

Amount of Jeffamine D-2000: 1968.4 parts.
Amount of Diethylene Triamine: 103 parts.

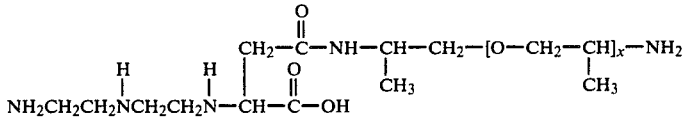

(where x is 33).

EXAMPLE VI

Amount of Jeffamine D-230: 114.8 parts.
Amount of Triethylene Tetramine: 145 parts.

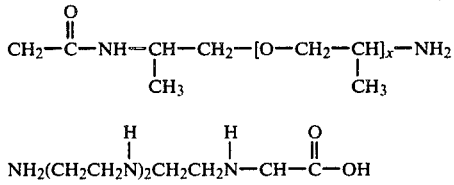

(where x is 2–3).

EXAMPLE VII

Amount of Jeffamine D-2000: 1968.4 parts.
Amount of Trietylene Tetramine: 145 parts.

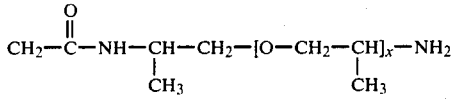

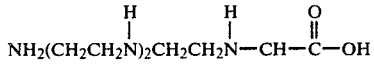

(where x is 33).

Preferred components for the lubricating oil of the invention are those which are effective in a range from about 0.1 to 5 weight percent based on the total lubricating oil composition. However, it is preferred to employ from about 0.5 to 2 weight percent of the derivative based the weight of the lubricating oil with the most preferred concentration ranging from about 0.75 to 1.5 weight percent.

The following Examples illustrate the best mode of making and using the oxidation and corrosion reducing additive component of the railway diesel oil composition of the invention.

The second essential component of the crankcase lubricating oil composition of the invention is an overbased calcium alkylphenolate or phenate or a sulfurized overbased calcium alkylphenolate in a sufficient amount to provide a Total Base Number ranging from 3 to 20 in the finished crankcase lubricating oil composition. The increase in viscosity is a measure of the oxidation increase and the metal weight loss is a measure of the corrosion deterioration.

OIL OXIDATION TEST

The test method involves bubbling 5 liters of oxygen per hour through 300 mls. of test oil composition at 285° F. in which there is immersed a 1×3×0.06 inch steel backed copper-lead test specimen cut from bearing stock. The viscosity of the test oil is measured before and after the 144 hour test period and greater the difference in viscosity the greater the oxidative deterioration of the instant invention. In addition, the test specimen is weighed before and after the test period and the greater the weight loss of test specimen the greater the corrosion deterioration of the test formulation. Further, the larger the amount of copper, iron and lead moieties found in the oil after test the greater the oxidative corrosion deterioration thereof.

The representative Formulations A, B, F, G and comparative Formulations C, D and F and their oxidation test results are reported below in Table II:

TABLE II

| OIL OXIDATION TEST[3] | | |
|---|---|---|
| Oil Code | A | B |
| Composition, wt % | | |
| Overbased [An alkaryl sulfonate/phenate[(1)]] | 4.10 | 4.10 |
| Ca salt of polyisobutenyl phenol-aldehyde-amine reaction solvent | 1.46 | 1.46 |
| Polyisobutylene | 0.44 | 0.44 |
| Branched alkyl ($C_{16}$) phenol | 0.88 | 0.88 |
| Chlorowax | 0.15 | 0.15 |
| SNO-320 | 19.64 | 20.14 |
| SNO-850 | 30.02 | 30.52 |
| 75/80 Pale Oil | 37.31 | 37.31 |
| Low Quality Marine Diesel fuel[(2)] | 5.00 | 5.00 |
| Experimental Anti-oxidation Anti-corrosion Additive I[(3)] | 1.0 | — |
| Test Results | | |
| Wt Loss-gm | 0.0079 | 0.2574 |
| Viscosity increase, % | 27.6 | 82.0 |

[(1)]The ratio of sulfonate to phenate is 1:1.
[(2)]Low quality marine diesel fuel (Banker-C); see Attachment I below for specifications.
[(3)]Reaction product of Jeffamine D-400, maleic anhydride & diethylene triamine.

| ATTACHMENT I | |
|---|---|
| Density, g/ml 15° C. | 0.962 |
| Viscosity, CST at 50° C. | 173 |
| Water content, 0/0 V/V | 0.0 |
| Conradson: Carbon residue, 0/0 M/M | 12.7 |
| Sulphur: 0/0 M/M | 1.47 |
| Ash, 0/0 M/M | 0.06 |
| Vandium: MG/KG | 30 |
| Sodium, MG/KG | 120– |
| Allminium, MG/KG | 16 |
| Silicon, MG/KG | 38 |
| Compatability with MGO | No. 1 |
| Calc. lower heat value, MJ/KG | 40.63 |

We claim:

1. A railway diesel crankcase lubricant composition comprising a diesel lubricating oil and from about 0.25 to 2.0 weight percent of minor amount of oxidation and corrosion inhibiting agent, the reaction product of a polyoxyisopropylene diamine, diabasic acid anhydride and polyalkylene polyamine wherein:

(i) reacting a dibasic acid anhydride with a polyoxyisopropylenediamine $$NH_2-\underset{\underset{CH_3}{|}}{CH}-CH_2-(OCH_2\underset{\underset{CH_3}{|}}{CH})_x-NH_2$$

where x is a numeral of about 2 to about 50, thereby forming a maleamic acid;

(ii) reacting said maleamic acid with a polyalkylene polyamine, thereby forming a condensate product and;

(iii) recovering said condensate product.

2. The railway diesel crankcase lubricant composition of claim 1, wherein said polyoxyisopropylenediamine has a molecular weight $\overline{M}_n$ ranging from about 230 to about 2000.

3. The railway diesel crankcase lubricant composition of claim 1, wherein said polyoxyisopropylenediamine, x is a numeral of about 2 to about 33.

4. The railway diesel crankcase lubricant composition of claim 1, wherein said dibasic acid anhydride has the formula

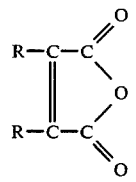

where R is H, $CH_3$— or $C_2H_5$—.

5. The railway diesel crankcase lubricant composition of claim 1, wherein said polyamine has the formula $$NH_2-(CH_2CH_2NH)_n-(CH_2CH_2)_m-NH_2$$

where n is a numeral of about 0 to about 4 and m is a numeral of about 0 to about 2.

6. The railway diesel crankcase lubricant composition of claim 1, wherein the minor anti-oxidation inhibiting amount ranges from about 0.25 to about 2.0 weight percent of the said reaction product.

7. The railway diesel crankcase lubricant composition of claim 6, wherein the minor anti-oxidation and anti-corrosion amount is about 0.25 to about 2.0 weight percent of said reaction product.

8. A railway diesel crankcase lubricant composition comprising:

(a) a major portion of a liquid naphthenic mineral oil having a viscosity of 300 at 100° F. paraffinic oil and naphthene mineral oil of 75–80 viscosity at 210° F.;

(b) a minor amount, as a deposit-inhibiting additive of a condensate product of the process comprising:

(i) reacting a polyoxyisopropylenediamine $$NH_2-\underset{\underset{CH_3}{|}}{CH}-CH_2-(OCH-\underset{\underset{CH_3}{|}}{CH})_x-NH_2$$

where x is a numeral of about 2 to about 50, with a dibasic acid anhydride

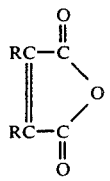

where R is H, $CH_3$— or $C_2H_5$—, thereby forming a maleamic acid;

(ii) reacting said maleamic acid with a polyalkylene polyamine $$NH_2—(CH_2CH_2NH)_n—(CH_2CH_2)_mNH_2$$

where n is about 0 to about 4 and m is about 0 to about 2, thereby forming a condensate product

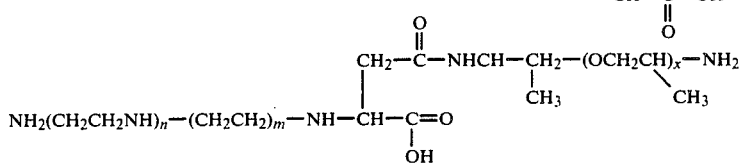

where x is about 2 to about 50; n is about 0 to about 4; and m is about 0 to about 2; and (iii) recovering said condensate product.

9. A diesel crankcase lubricant composition:

(a) a major portion of a liquid having a naphthenic mineral oil of viscosity of 300 at 100° F., paraffinic mineral oil, naphthenic mineral oil of 75–80 viscosity at 210° F. and (b) about 1 wt.% of a anti-oxidation and corrosion-inhibiting condensate product of the process comprising:

(i) reacting a polyoxyisopropylenediamine

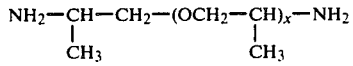

where x is a numeral of about 2 to about 50 with maleic anhydride, thereby forming a maleamic acid

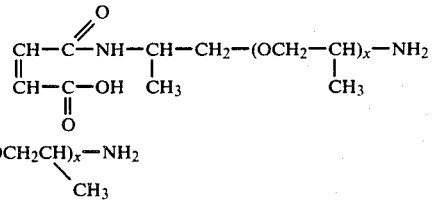

(ii) reacting said maleamic acid with diethylene triamine, thereby forming a condensate product

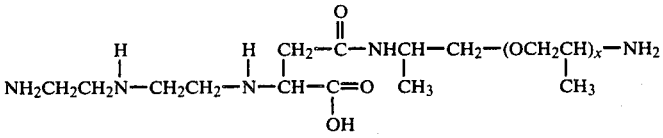

and (iii) recovering said condensate product.

* * * * *